US008958592B2

(12) United States Patent
Huang et al.

(10) Patent No.: US 8,958,592 B2
(45) Date of Patent: Feb. 17, 2015

(54) MICROPHONE ARRAY HOUSING WITH ACOUSTIC EXTENDING STRUCTURE AND ELECTRONIC DEVICE UTILIZING THE SAME

(71) Applicant: Fortemedia, Inc., Sunnyvale, CA (US)

(72) Inventors: Yen-Son Paul Huang, Los Altos Hills, CA (US); Iou-Din Jean Chen, San Jose, CA (US); James Juei Son Lin, Sunnyvale, CA (US)

(73) Assignee: Fortemedia, Inc., Santa Clara, CA (US)

( * ) Notice: Subject to any disclaimer, the term of this patent is extended or adjusted under 35 U.S.C. 154(b) by 0 days.

(21) Appl. No.: 13/901,081

(22) Filed: May 23, 2013

(65) Prior Publication Data

US 2014/0348370 A1 Nov. 27, 2014

(51) Int. Cl.

| | |
|---|---|
| ***H04R 1/02*** | (2006.01) |
| ***H04R 1/08*** | (2006.01) |
| *H04R 1/40* | (2006.01) |
| *H04R 1/32* | (2006.01) |

(52) U.S. Cl.

CPC ..... *H04R 1/08* (2013.01); *H04R 2201/003* (2013.01); *H04R 1/406* (2013.01); *H04R 1/02* (2013.01); *H04R 1/326* (2013.01); *H04R 2201/403* (2013.01)

USPC ..... 381/351; 381/355; 381/357; 381/182; 381/186; 381/345; 381/360; 181/144; 181/145

(58) Field of Classification Search

CPC ..... H04R 1/02; H04R 1/026; H04R 1/04; H04R 1/32; H04R 1/326; H04R 1/40; H04R 1/406; H04R 2201/003; H04R 2201/02; H04R 2201/40; H04R 2201/403; H04R 2205/022; H04R 29/004–29/006

USPC ..... 381/357, 356, 361, 365, 322, 324, 113, 381/351, 360, 186, 345, 355, 182; 181/144, 181/145, 148, 198, 199

See application file for complete search history.

(56) References Cited

U.S. PATENT DOCUMENTS

| | | | | |
|---|---|---|---|---|
| 6,151,399 | A * | 11/2000 | Killion et al. | 381/313 |
| 7,933,428 | B2 * | 4/2011 | Sawada | 381/357 |
| 8,155,364 | B2 * | 4/2012 | An et al. | 381/357 |
| 8,457,342 | B2 * | 6/2013 | Tanaka et al. | 381/357 |
| 8,472,639 | B2 * | 6/2013 | Reining | 381/92 |
| 8,724,836 | B2 * | 5/2014 | Larsen | 381/322 |
| 2007/0127759 | A1 * | 6/2007 | Zhang et al. | 381/338 |

(Continued)

FOREIGN PATENT DOCUMENTS

JP 2007-104556 A * 4/2007 ..... H04R 1/40

*Primary Examiner* — Curtis Kuntz
*Assistant Examiner* — Joshua A Kaufman
(74) *Attorney, Agent, or Firm* — McClure, Qualey & Rodack, LLP

(57) ABSTRACT

An electronic device is provided. The electronic device includes a case, a microphone array housing consists of a first acoustic extending structure, a second acoustic extending structure, an interface IC, a first membrane and a second membrane. The case includes a first acoustic opening and a second acoustic opening. The first acoustic extending structure is connected to the first acoustic opening. The second acoustic extending structure is connected to the second acoustic opening. The first membrane receives a first acoustic signal via the first acoustic opening and the first acoustic extending structure. The second membrane receives a second acoustic signal via the second acoustic opening and the second acoustic extending structure.

9 Claims, 6 Drawing Sheets

(56) References Cited

U.S. PATENT DOCUMENTS

| | | | | |
|---|---|---|---|---|
| 2007/0177752 | A1* | 8/2007 | Kargus, IV | 381/357 |
| 2008/0013770 | A1* | 1/2008 | Wu et al. | 381/357 |
| 2008/0069389 | A1* | 3/2008 | Zhang et al. | 381/355 |
| 2008/0240471 | A1* | 10/2008 | Chen et al. | 381/150 |
| 2010/0054495 | A1* | 3/2010 | Harney et al. | 381/92 |
| 2011/0265574 | A1* | 11/2011 | Yang | 73/658 |
| 2013/0070951 | A1* | 3/2013 | Tanaka et al. | 381/361 |
| 2013/0101151 | A1* | 4/2013 | Harney et al. | 381/356 |
| 2014/0161295 | A1* | 6/2014 | Huang et al. | 381/357 |

* cited by examiner

MICROPHONE ARRAY HOUSING WITH ACOUSTIC EXTENDING STRUCTURE AND ELECTRONIC DEVICE UTILIZING THE SAME

BACKGROUND OF THE INVENTION

1. Field of the Invention

The present invention relates to a microphone array with an acoustic extending structure, which utilizes the acoustic extending structure so as to:

i. increase the distance between of acoustic openings; and ii. provide phase matching between microphone membranes 2. Description of the Related Art Microphone arrays used in mobile communication devices using two or more microphone membranes are getting more and more popular nowadays because more acoustic information can be received thereby versus the conventional single microphone for the separation of a desired voice and unwanted noises. The CMOS-MEMS (Micro-Electro-Mechanical Systems) technology allows fabrication of microphone arrays on one single chip to the size and pin out of a single microphone with two chips. In this case, the center to center distance between the two microphone membranes is smaller than the minimum distance required for voice processing algorithms.

BRIEF SUMMARY OF THE INVENTION

In one embodiment of the invention, an electronic device is provided utilizing small array microphone (SAM). The electronic device includes a case, a microphone array housing consists of a first acoustic extending structure, a second acoustic extending structure, an interface IC, a first membrane and a second membrane. The case includes a first acoustic opening and a second acoustic opening. The first acoustic extending structure is connected to the first acoustic opening. The second acoustic extending structure is connected to the second acoustic opening. The first membrane receives a first acoustic signal via the first acoustic opening and the first acoustic extending structure. The second membrane receives a second acoustic signal via the second acoustic opening and the second acoustic extending structure.

In another embodiment of the invention, a microphone array is provided. The microphone array comprises a first acoustic extending structure, a second acoustic extending structure, an interface IC, a first membrane and a second membrane. A first sound inlet is formed on the first acoustic extending structure. A second sound inlet is formed on the second acoustic extending structure. The first membrane receives a first acoustic signal via the first sound inlet and the first acoustic extending structure. The second membrane receives a second acoustic signal via the second sound inlet and the second acoustic extending structure. The microphone array consists of two membranes and an interface IC placed in between. The interface IC is an integration of two transducers or an integration of two transducers and a phase/sensitivity matching logic or more.

In the embodiment of the invention, the first acoustic extending structure and the second acoustic extending structure establish two separated sound paths from acoustic openings to the membranes. Utilizing the embodiments of the invention, the effective distance of the microphone can be extended.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
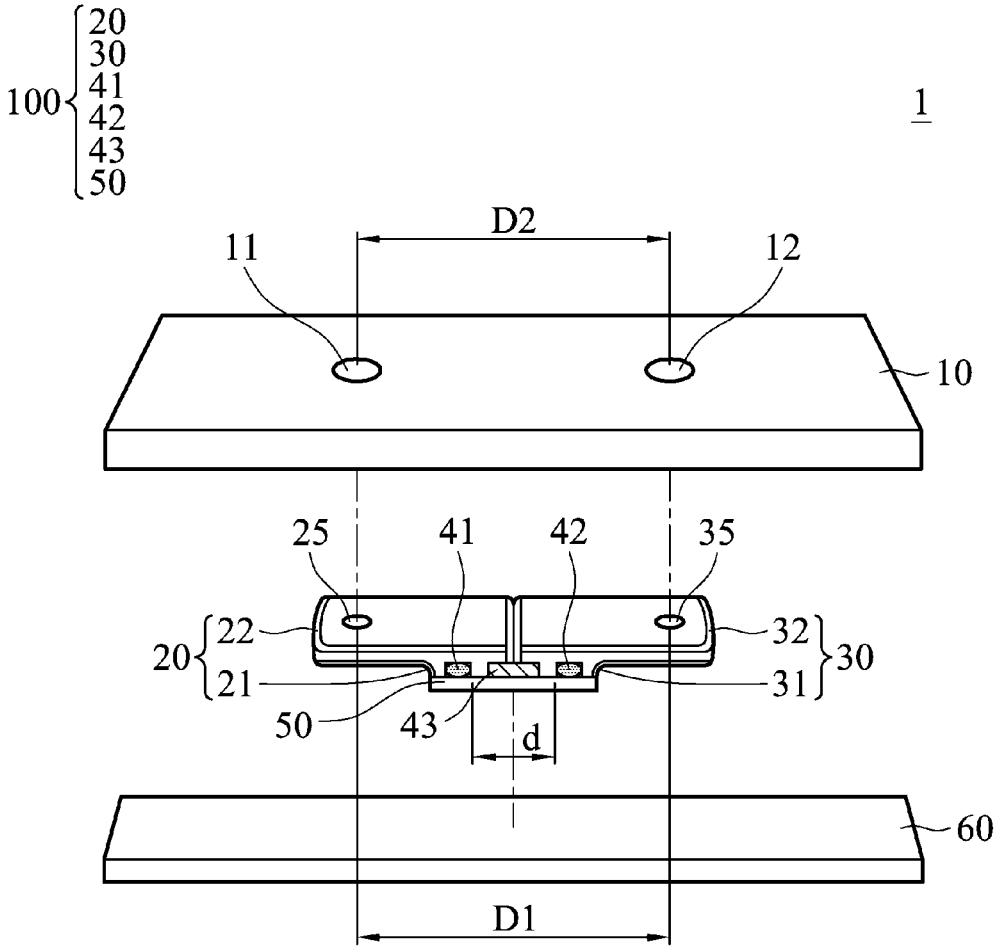
FIG. 1A shows a Top Port Microphone Array Housing with Acoustic Extending Structure—Wing Shaped.
Figure 1B:
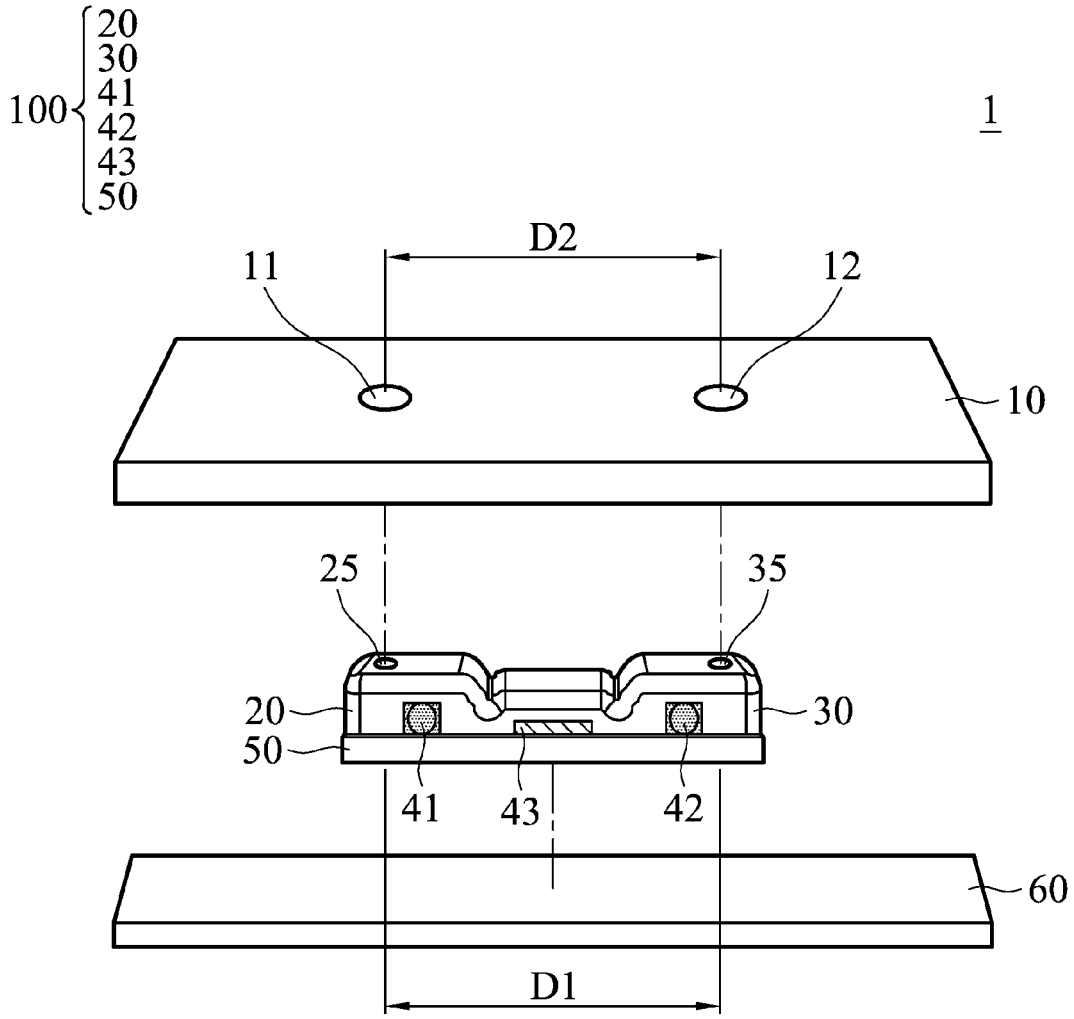
FIG. 1B shows a Top Port Microphone Array Housing with Acoustic Extending Structure by placing Interface IC between two chambers.
Figure 1C:
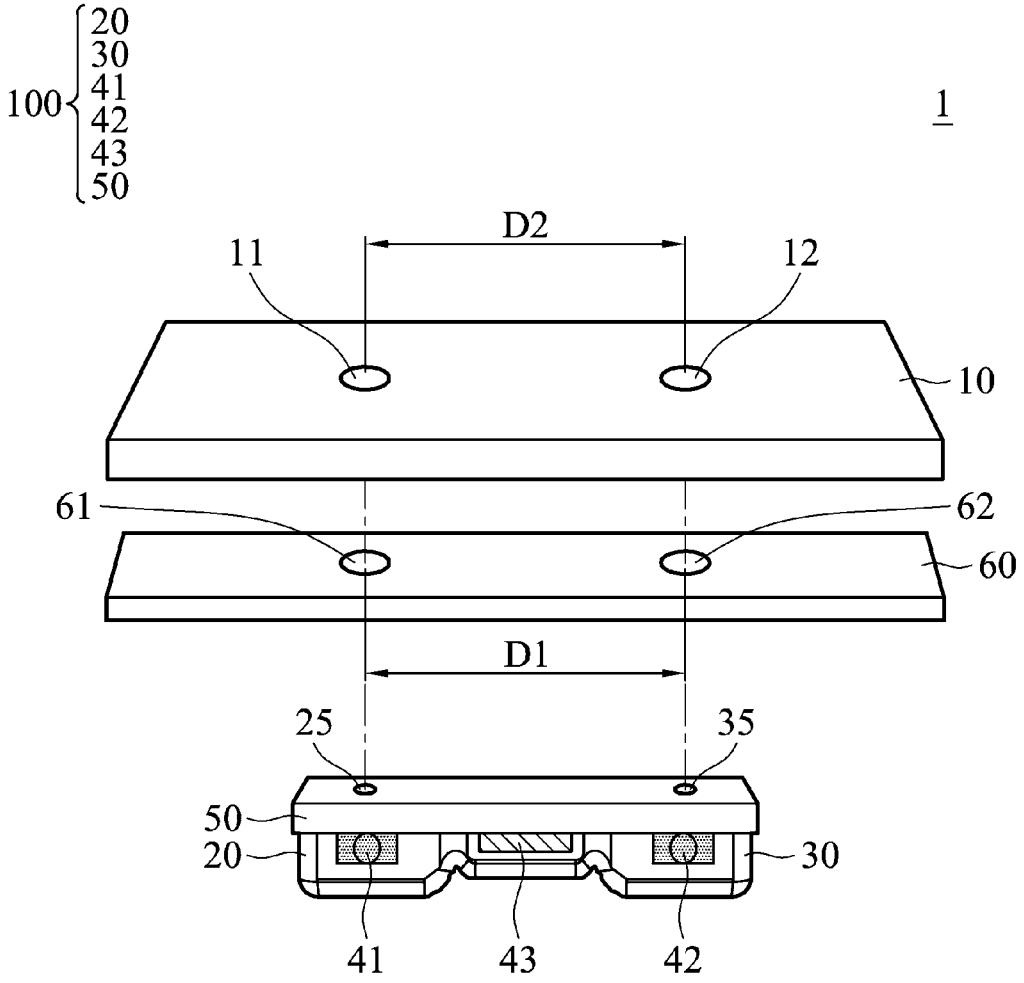
FIG. 1C shows a Bottom Port Microphone Array Housing with Acoustic Extending Structure by placing Interface IC between two chambers.

FIG. 1A, FIG. 1B and FIG. 1C show an electronic device 1 of a first embodiment of the invention, which comprises a case 10, a microphone array 100 and a device circuit board 60. The microphone array 100 comprises a first acoustic extending structure 20, a second acoustic extending structure 30, a first membrane 41, a second membrane 42, and a microphone array circuit board 50. The case 10 comprises a first acoustic opening 11 and a second acoustic opening 12. The first acoustic extending structure 20 is connected to the first acoustic opening 11. The second acoustic extending structure 30 is connected to the second acoustic opening 12. The first membrane 41 receives a first acoustic signal via the first acoustic opening 11 and the first acoustic extending structure 20. The second membrane 42 receives a second acoustic signal via the second acoustic opening 12 and the second acoustic extending structure 30. The first membrane 41, the second membrane 42 and an interface IC 43 are disposed on the microphone array circuit board 50. The microphone array circuit board 50 is electrically connected to the device circuit board 60.

Refer to FIG. 1A, the first acoustic extending structure 20 and the second acoustic extending structure 30 are wing-shaped. The first acoustic extending structure 20 comprises a first base portion 21 and a first extending portion 22, and the first extending portion 22 is connected to the first base portion 21. The second acoustic extending structure 30 comprises a second base portion 31 and a second extending portion 32, and the second extending portion 32 is connected to the second base portion 31. The first extending portion 22 extends in a direction opposite to the second extending portion 32.

A first sound inlet 25 is formed on the first extending portion 22, and a second sound inlet 35 is formed on the sound extending portion 32. The first sound inlet 25 is communicated with the first acoustic opening 11, and the second sound inlet 35 is communicated with the second acoustic opening 12.

FIG. 1B shows an electronic device 1 of a second embodiment of invention. Compared with FIG. 1A, the difference of the extending structure is that an interface IC 43 is placing in the middle to eliminate the acoustic extending portion in FIG. 1A and push the first base portion in a direction opposite to the second base portion to form an acoustic extending structure.

Refer to FIG. 1C and compared to FIG. 1B, the first difference is that the sound inlets are on the bottom of microphone array (so called bottom port design) while in FIG. 1B, the sound inlets are on the top of microphone array (so called top port design). The second difference is the sound inlets (25, 35) communicated with the acoustic openings (11, 12) are through holes (61, 62) in device circuit board respectively. In the embodiment of the invention, the first acoustic extending structure 20 and the second acoustic extending structure 30 establish two separated sound paths FIG. 1C shows an electronic device 1 wherein a first through hole 61 and a second through hole 62 are formed on the device circuit board 60. The first membrane 41 corresponds to the first through hole 61, and the second membrane 42 corresponds to the second through hole 62. The first acoustic extending structure 20 is connected to the first through hole 61, and the second acoustic extending structure 30 is connected to the second through hole 62. The interface IC 43 is disposed between the first membrane 41 and the second membrane 42. The interface IC 43, the first membrane 41 and the second membrane 42 are disposed in one single housing 80, and the interface IC 43 acoustically insolates the first membrane 41 from the second membrane 42 so that a first acoustic extending structure 20 and a second acoustic extending structure 30 are further provided. The first membrane 41 is disposed in the first housing 20, and the second membrane 42 is disposed in the second housing 30. In this embodiment, a bottom port microphone design is applied, which provides better airtight, better phase and sensitivity matching and a better signal-to-noise ratio (SNR) because it uses chambers of housings as its cavities.

Utilizing the embodiments of the invention, the microphone effective distance from the acoustic openings (11, 12) to the membranes (41, 42) can be extended to D1 and D2, for example D1=5 mm to 10 mm, and D2=5 mm to 20 mm.

Figure 2A:
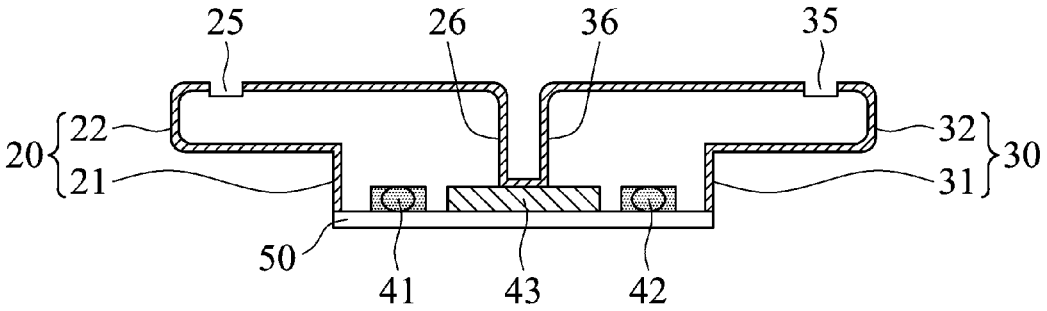
FIGS. 2A, 2B and 2C are a cross sectional view of the microphone array of the first and second embodiment of the invention.

FIG. 2A is a cross sectional view of FIG. 1A of microphone array housing, wherein the first acoustic extending structure 20 comprises a first wall 26, and the second acoustic extending structure 30 comprises a second wall 36. The first wall 26 is opposite to the second wall 36, and the first wall 26 and the second wall 36 contacts the microphone array circuit board 50.

Figure 2B:
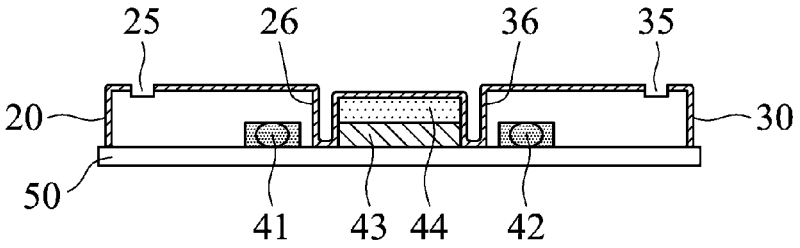
Figure 2C:
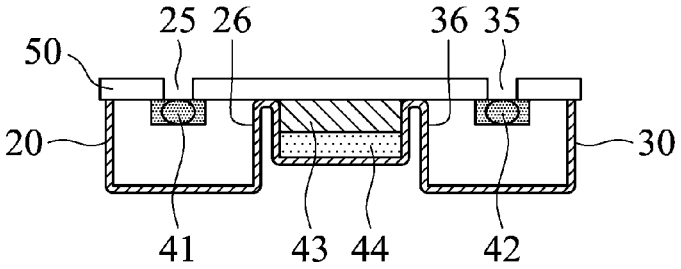

FIG. 2B and FIG. 2C are a cross sectional view of FIG. 1B and FIG. 1C respectively. The microphone array housing shows a microphone array of a second embodiment of the invention, wherein an interface IC 43 (Integrated Circuit) is disposed on the microphone array circuit board 50, and placed between the first acoustic extending structure 20 and the second acoustic extending structure 30. The interface IC 43 greatly improves the airtightness between the first membrane 41 from the second membrane 42 if compared just use two walls (26, 36). In this embodiment, the interface IC 43 is an integration of two transducers, a phase/sensitivity matching circuit and other digital signal processing features.

Figure 3A:
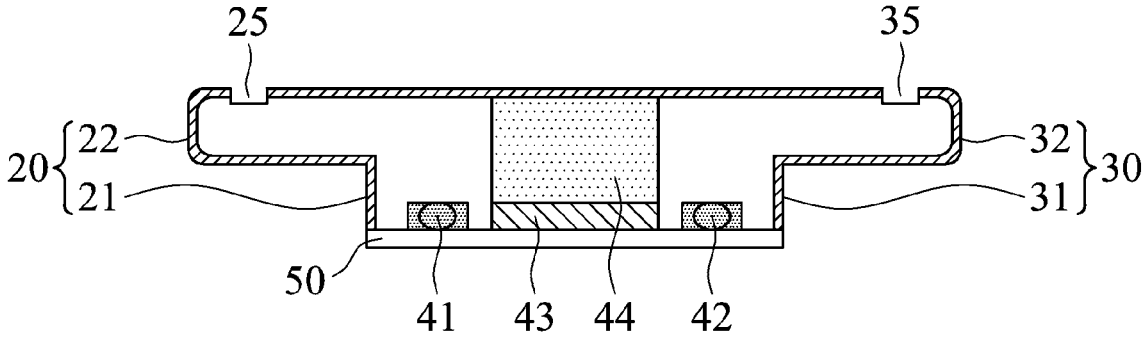
FIGS. 3A, 3B and 3C shows the microphone array of the third and fourth embodiment of the invention.
Figure 3B:
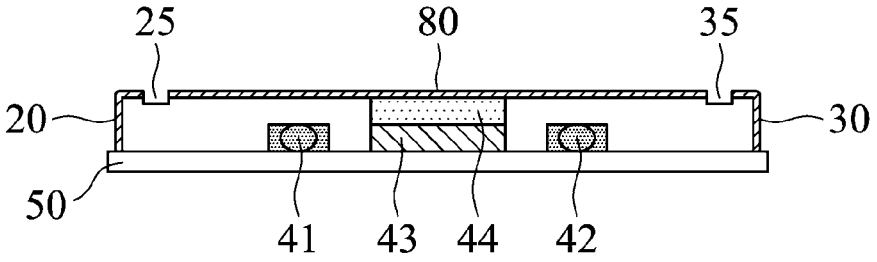
Figure 3C:
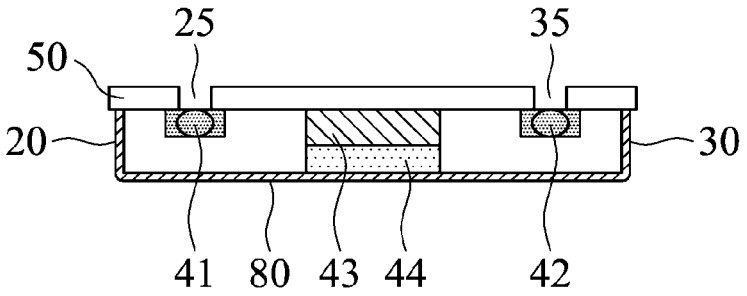
Figure 4A:
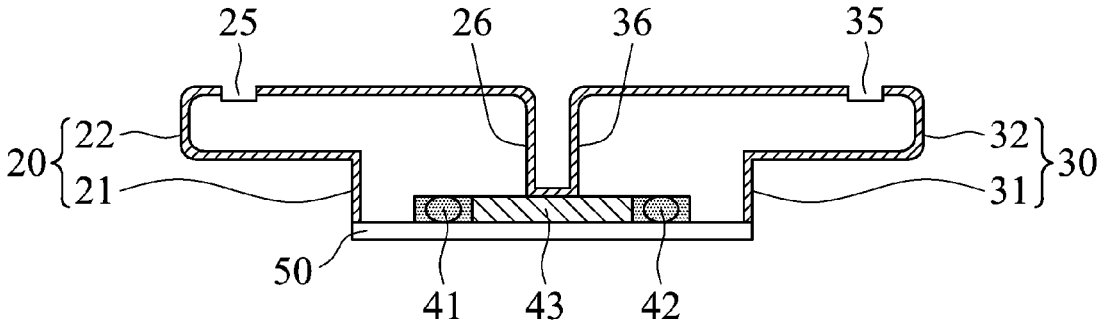
FIGS. 4A, 4B and 4C shows the microphone array of the fifth embodiment of the invention.
Figure 4B:
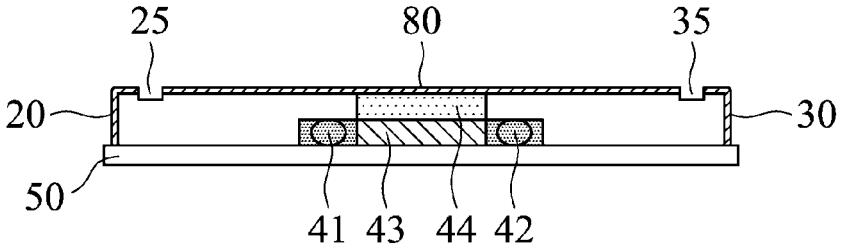
Figure 4C:
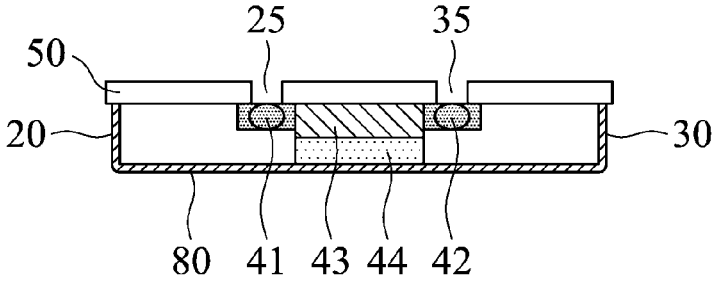

FIG. 3B and FIG. 3C show the microphone array housing of the third embodiment of the invention, wherein the first acoustic extending structure 20 and the second acoustic extending structure 30 comprises a wall formed by interface IC 43 with thicker package or add a rubber 44 to increase the thickness. In this case a single cap can be used to form two isolated chamber for two membranes FIG. 4A, FIG. 4B and FIG. 4C show the microphone array of a fourth embodiment of the invention, wherein the interface IC 43, the first membrane 41 and the second membrane 42 are integrated into one single element by CMOS-MEMS process technology.

The electronic device can be a mobile phone, notebook, tablet or other portable electronic devices. The electronic device can also be a television, computer or other electronic devices.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a case, comprising a first acoustic opening, and a second acoustic opening;

a first acoustic extending structure, wherein the first acoustic extending structure is connected to the first acoustic opening, wherein the first acoustic extending structure abuts the case;

a second acoustic extending structure, wherein the second acoustic extending structure is connected to the second acoustic opening, wherein the second acoustic extending structure abuts the case;

a first membrane, receiving a first acoustic signal via the first acoustic opening and the first acoustic extending structure; and a second membrane, receiving a second acoustic signal via the second acoustic opening and the second acoustic extending structure, wherein the entire first acoustic extending structure comprises a wing-shaped chamber, and the entire second acoustic extending structure comprises another wing-shaped chamber, and the first chamber is symmetrical to the second chamber.

2. The electronic device as claimed in claim 1, wherein the electronic device further comprises a microphone array circuit board, and an interface IC, the first membrane and the second membrane are disposed on the microphone array circuit board.

3. The electronic device as claimed in claim 1, wherein an interface IC is placed on microphone array circuit board between the first membrane and the second membrane, and the first membrane is disposed in the first extending structure and the second membrane is disposed in the second acoustic extending structure, and the interface IC and two acoustic extending structures acoustically isolate the first membrane from the second membrane.

4. The electronic device as claimed in claim 3, wherein the interface IC, the first membrane and the second membrane are disposed in one single housing and the interface IC with package acoustically insolates the first membrane in the first chamber from the second membrane in the second chamber.

5. The electronic device as claimed in claim 4, wherein the interface IC, the first membrane and the second membrane are integrated into one single element by CMOS-MEMS process technology.

6. The electronic device as claimed in claim 5, further comprising a device circuit board, wherein a first through hole and a second through hole are formed on the device circuit board, and the first membrane corresponds to the first through hole, and the second membrane corresponds to the second through hole, and the interface IC, the first membrane and the second membrane are disposed in one single housing and the interface IC with package acoustically insolates the first membrane in first chamber from the second membrane in a second chamber.

7. The electronic device as claimed in claim 3, wherein the first acoustic extending structure comprises a first wall, the second acoustic extending structure comprises a second wall, the first wall faces the second wall, and both the first wall and the second wall stand on the interface IC.

8. The electronic device as claimed in claim 1, wherein a cross section of the first chamber is L-shaped, and a cross section of the second chamber is L-shaped.

9. The electronic device as claimed in claim 8, wherein the first chamber comprises a first base portion and a first extending portion, a width of the first extending portion is longer than a width of the first base portion, the second chamber comprises a second base portion and a second extending portion, and a width of the second extending portion is longer than a width of the second base portion.

* * * * *

UNITED STATES PATENT AND TRADEMARK OFFICE

CERTIFICATE OF CORRECTION

PATENT NO. : 8,958,592 B2
APPLICATION NO. : 13/901081
DATED : February 17, 2015
INVENTOR(S) : Huang et al.

It is certified that error appears in the above-identified patent and that said Letters Patent is hereby corrected as shown below:

Title Page, item (54) and in the Specification, Column 1, Line 1, the title should be "Microphone Array Housing with Acoustic Extending Structure and Electronic Device Utilizing the SAM"

Signed and Sealed this
Twenty-third Day of June, 2015

Michelle K. Lee

Michelle K. Lee
*Director of the United States Patent and Trademark Office*